US007987791B2

(12) United States Patent
Schneider et al.

(10) Patent No.: US 7,987,791 B2
(45) Date of Patent: Aug. 2, 2011

(54) METHOD OF DISRUPTING ELECTRICAL POWER TRANSMISSION

(75) Inventors: John Felix Schneider, Huntingburg, IN (US); Christopher Allen Brown, Bloomington, IN (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 173 days.

(21) Appl. No.: 12/415,754

(22) Filed: Mar. 31, 2009

(65) Prior Publication Data

US 2010/0242777 A1 Sep. 30, 2010

(51) Int. Cl.
*F42B 12/68* (2006.01)

(52) U.S. Cl. ..... 102/504; 102/505; 102/351; 102/357; 102/439; 89/1.11

(58) Field of Classification Search ..... 102/504–505, 102/351, 357, 439, 457, 438, 529; 89/1.11
See application file for complete search history.

(56) References Cited

U.S. PATENT DOCUMENTS

| | | | | |
|---|---|---|---|---|
| 1,664,401 | A * | 4/1928 | Craig | 446/475 |
| 2,274,655 | A * | 3/1942 | Bickel | 102/504 |
| 2,296,980 | A * | 9/1942 | Carmichael | 102/504 |
| 3,137,231 | A | 6/1964 | Johnson | |
| 3,760,735 | A * | 9/1973 | Schmitt | 102/451 |
| 4,031,828 | A | 6/1977 | Larson | |
| 4,129,078 | A | 12/1978 | Schneider, Jr. et al. | |
| 4,178,854 | A * | 12/1979 | Schillreff | 102/377 |
| 4,183,302 | A * | 1/1980 | Schillreff | 102/377 |
| 4,195,571 | A | 4/1980 | Beeker et al. | |
| 4,294,447 | A * | 10/1981 | Clark | 473/575 |
| 4,307,665 | A * | 12/1981 | Block et al. | 102/505 |
| 4,333,402 | A | 6/1982 | Landstrom et al. | |
| 4,374,494 | A * | 2/1983 | Maury | 102/357 |
| 4,549,489 | A | 10/1985 | Billard et al. | |
| 4,704,966 | A | 11/1987 | Sellman et al. | |
| 4,726,295 | A | 2/1988 | Embury, Jr. et al. | |
| 5,025,729 | A | 6/1991 | Cameron | |
| 5,033,385 | A * | 7/1991 | Zeren | 102/439 |
| 5,329,854 | A | 7/1994 | Komstadius et al. | |
| 5,410,967 | A * | 5/1995 | Peritt | 102/439 |
| 5,661,257 | A | 8/1997 | Nielson et al. | |
| 5,834,682 | A * | 11/1998 | Warren | 102/439 |
| 6,513,438 | B1 | 2/2003 | Fegg et al. | |
| 7,314,007 | B2 * | 1/2008 | Su | 102/502 |
| 2004/0200381 | A1 | 10/2004 | Zatterqvist | |
| 2005/0075043 | A1 * | 4/2005 | Lorenzana | 446/475 |
| 2006/0283348 | A1 * | 12/2006 | Lloyd | 102/497 |
| 2009/0241402 | A1 * | 10/2009 | Kraft | 43/3 |
| 2010/0242775 | A1 * | 9/2010 | Schneider et al. | 102/504 |
| 2010/0242776 | A1 * | 9/2010 | Schneider et al. | 102/504 |

OTHER PUBLICATIONS

Military Analysis Network, CBU-94 "Blackout Bomb,"BLU 114/B "Soft Bomb," from www.fas.org/man/dod-101/sys/dumb/blu-114.htm, updated May 7, 1999, 6 pgs.

* cited by examiner

*Primary Examiner* — Bret Hayes
*Assistant Examiner* — Michael David
(74) *Attorney, Agent, or Firm* — Christopher A. Monsey

(57) ABSTRACT

A method of disrupting electrical power transmission including the steps of launching a projectile from a hand-held launcher, ejecting a plurality of electrically conductive members from the projectile, and bridging electrical contacts of power transmission equipment.

15 Claims, 5 Drawing Sheets

METHOD OF DISRUPTING ELECTRICAL POWER TRANSMISSION

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon.

BACKGROUND OF THE INVENTION

The present invention relates generally to devices for interrupting power distribution, and more particularly, to devices for temporarily short circuiting power storage and/or distribution equipment.

Devices for temporarily disabling electrical power infrastructure are known. For example, airplane deployed devices are known to disperse large numbers of carbon graphite filaments which short-circuit electrical power distribution equipment, such as transformers and switching stations. Such electrical power disruption devices deny certain undesired individuals access to electricity, while permitting electrical power to be later restored relatively quickly and inexpensively. It is desirable to provide improved electrical power disruption devices including effective deployment of conductive members and/or that may be ground deployable.

SUMMARY OF THE INVENTION

According to an illustrative embodiment of the present disclosure, a method of disrupting electrical power transmission includes the steps of launching a projectile above power transmission equipment, ejecting a plurality of electrically conductive streamers from the projectile, and causing each of the plurality of electrically conductive streamers to extend in a streaming manner. The method further includes the step of bridging electrical contacts of the power transmission equipment by the plurality of electrically conductive streamers descending onto the power transmission equipment.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

Figure 1:
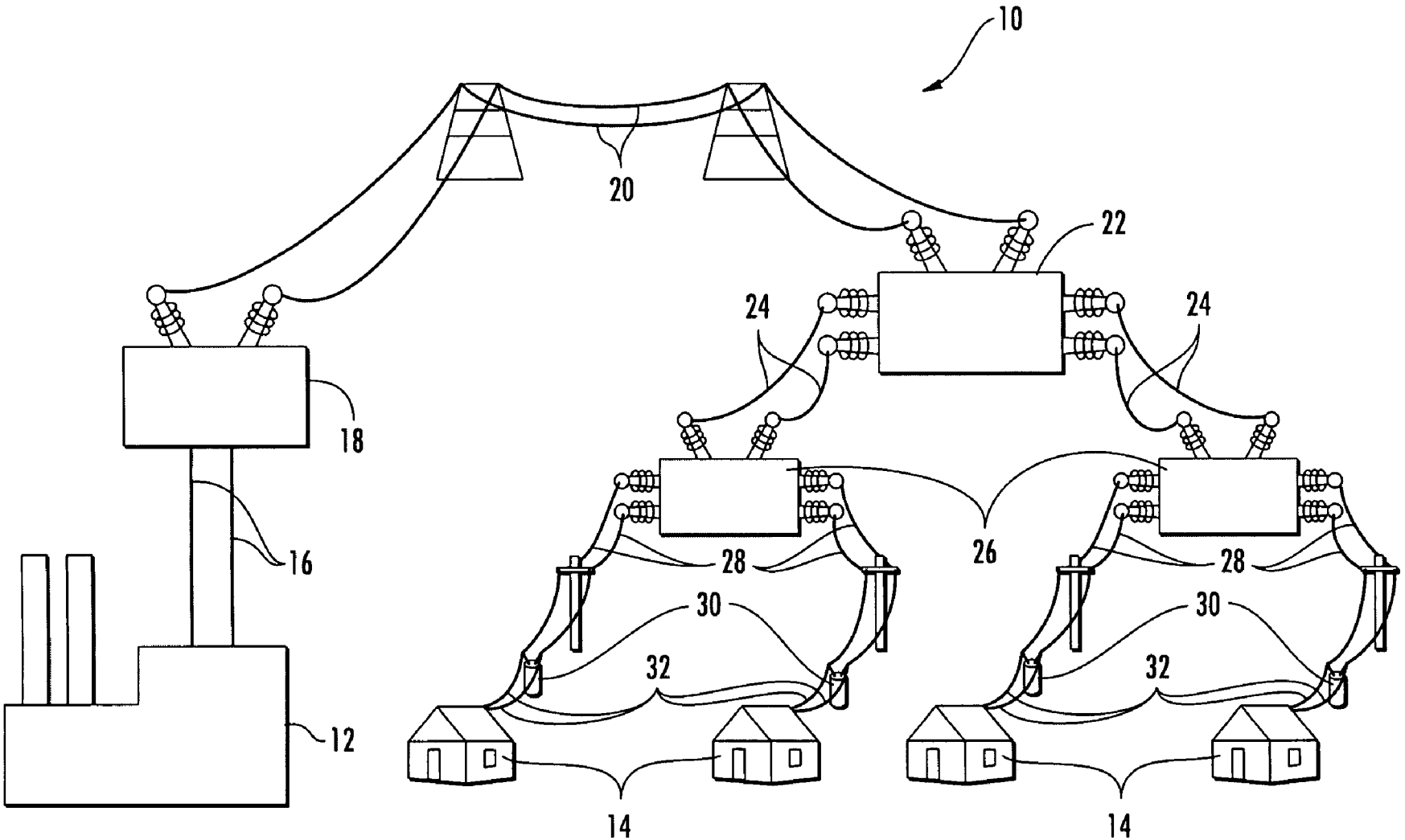
FIG. 1 is a diagrammatic view of an illustrative electrical distribution system.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplification set out herein illustrates embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Referring initially to FIG. 1, an illustrative electrical distribution system or power grid 10 is shown for distributing electrical power from a power generation plant 12 to consumers 14. Initially, electricity from the power generation plant 12 is transmitted via transmission lines 16 to a step-up transformer 18 that typically boosts voltage up to approximately 400,000 volts for distribution through extra-high voltage (EHV) transmission lines 20. The transmission lines 20 transfer electricity to a bulk power sub-station 22 where a reduction in voltage typically occurs for distribution to other points in the grid 10 through high voltage (HV) transmission lines 24. Additional voltage reductions for consumers take place at distribution sub-stations 26. Electricity is then transferred via transmission lines 28 to local transformers 30, which may further step down voltages of electricity which is then supplied through lines 32 to the individual consumers 14.

Figure 2:
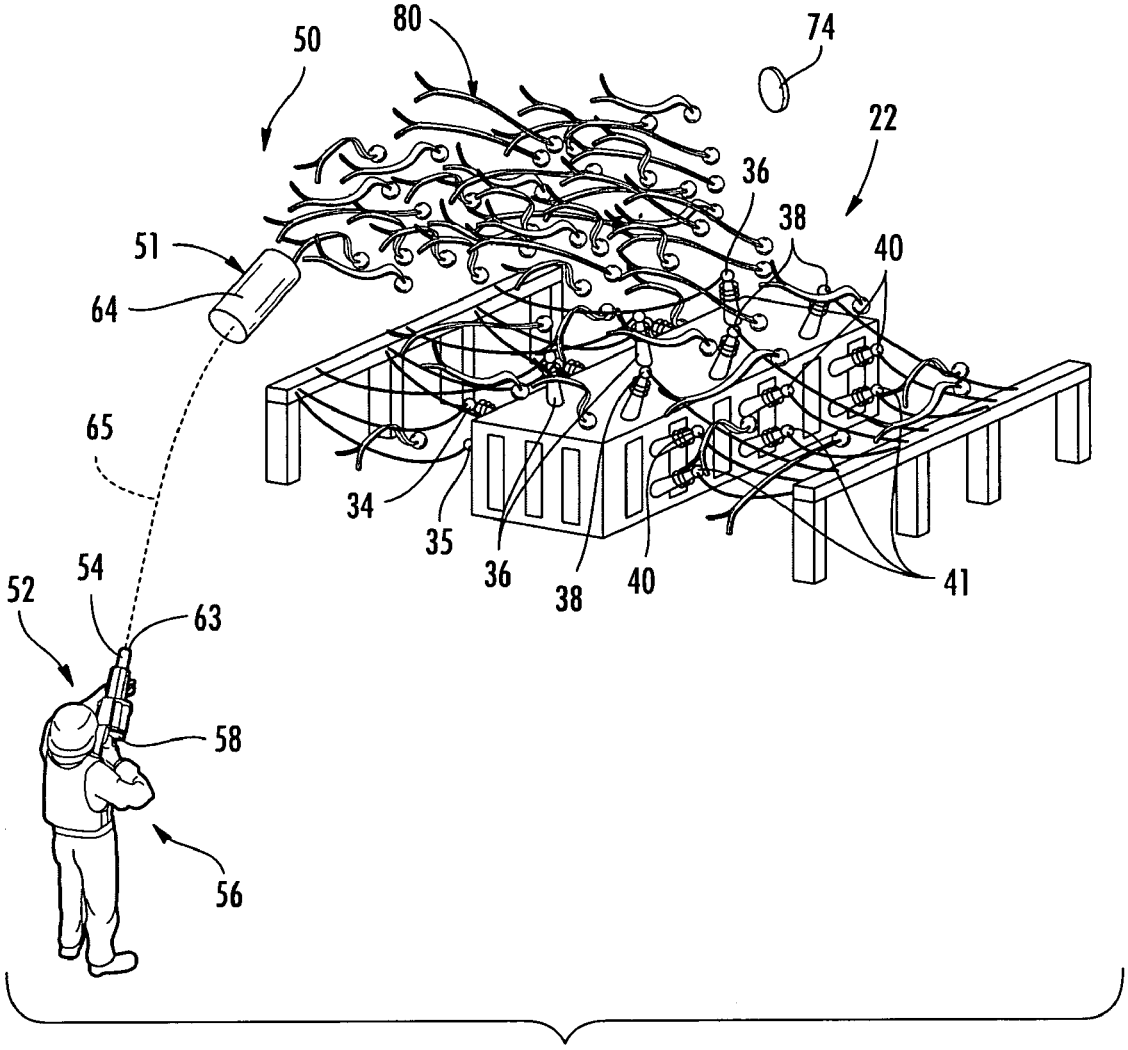
FIG. 2 is a perspective view, in partial schematic, of a user launching an illustrative projectile of an electrical power disruption device above power distribution equipment of FIG. 1, with electrical conductive members shown in a streaming mode.

As is known, electrical contacts are located throughout the power grid 10. For example, an illustrative sub-station 22 is shown in FIG. 2 as including a plurality of electrical contacts 34, 35, 36, 38, 40, 41. It is also known that bridging certain electrical contacts 34, 35, 36, 38, 40, 41 may cause a short circuit, thereby tripping certain protective devices, such as circuit breakers (not shown). By tripping the protective devices, electrical power storage and distribution downstream in the power grid 10 may be interrupted, until the equipment is repaired and the protective devices are reset.

With further reference to FIG. 2, an electrical power disruption device 50 according to the present disclosure is shown as including a projectile 51 propelled upwardly from a hand held projectile launcher 52. In the illustrative embodiment, the projectile launcher 52 may comprise an M-203 grenade launcher or a multi-shot M-32 multiple grenade launcher (MGL). Illustratively, the projectile 51 includes external dimensions similar to a conventional 40 mm grenade. Other small arms, such as shotguns may also be used to launch the projectile 51.

The projectile launcher 52 illustratively includes a launch tube or barrel 54 and is configured to be hand supported or held by a user 56. As is known, the projectile launcher 52 includes a trigger 58 that is configured to cause a firing pin 59 to mechanically interface with a casing 60 positioned rearwardly of the projectile 51 positioned within the launch tube 54. More particularly, the firing pin 59 is configured to detonate a primer 61 and cause activation of a propellant 62 to propel or discharge the projectile 51 from the discharge end 63 of the launch tube 54. As such, the projectile 51 is launched or propelled upwardly along a trajectory 65. The casing 60 may subsequently be manually ejected from the launch tube 54.

While a hand held projectile launcher 52 is shown in the illustrative embodiment, other projectile delivery devices may be substituted therefor. For example, in certain embodiments, the projectile 51 may be delivered via an aircraft deployed ordnance, a mortar, or a cruise missile.

Figure 4:
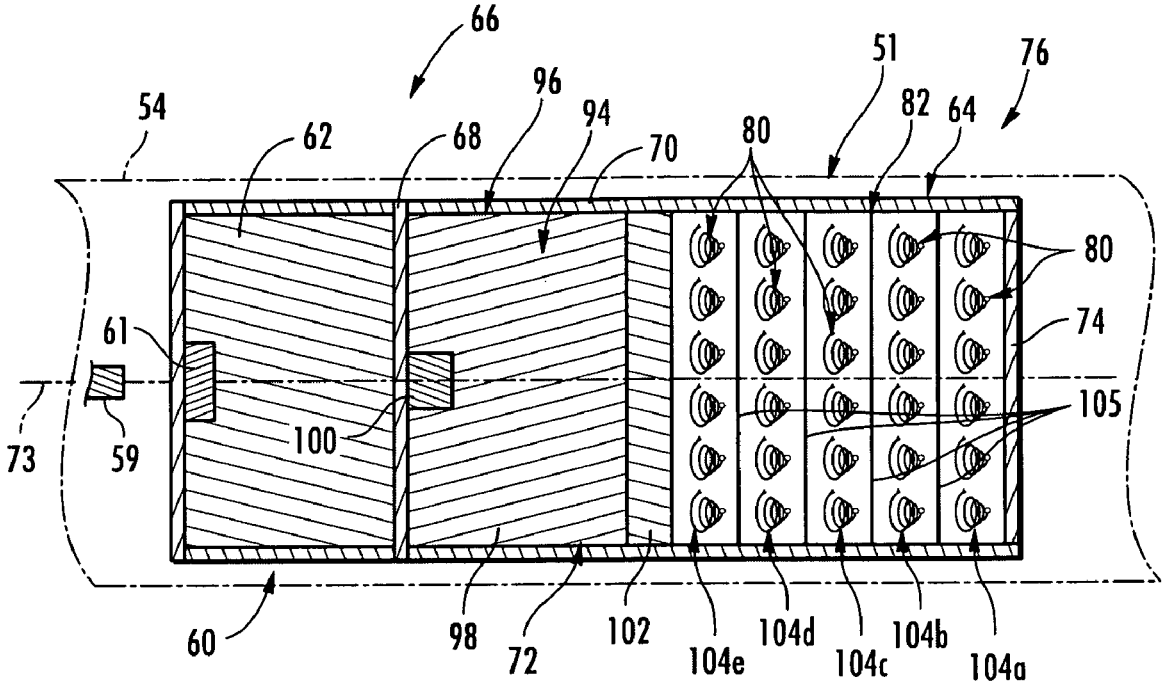
FIG. 4 is a cross-sectional view, in partial schematic, of the illustrative projectile of FIG. 2, prior to being launched.

With reference now to FIGS. 2 and 4, the projectile 51 illustratively includes a housing 64 having a first or proximal end 66 including a base 68 coupled to a cylindrical sidewall 70 for defining a chamber 72 extending along a longitudinal axis 73. An end cap 74 may be secured to the second or distal end 76 of the housing 64 and is configured to be disengaged therefrom by application of an outwardly directed force. For example, the end cap 74 may be secured to the sidewall 70 via a breakaway fastener, such as an adhesive or screws configured to release upon the application of a predetermined force.

Figure 5:
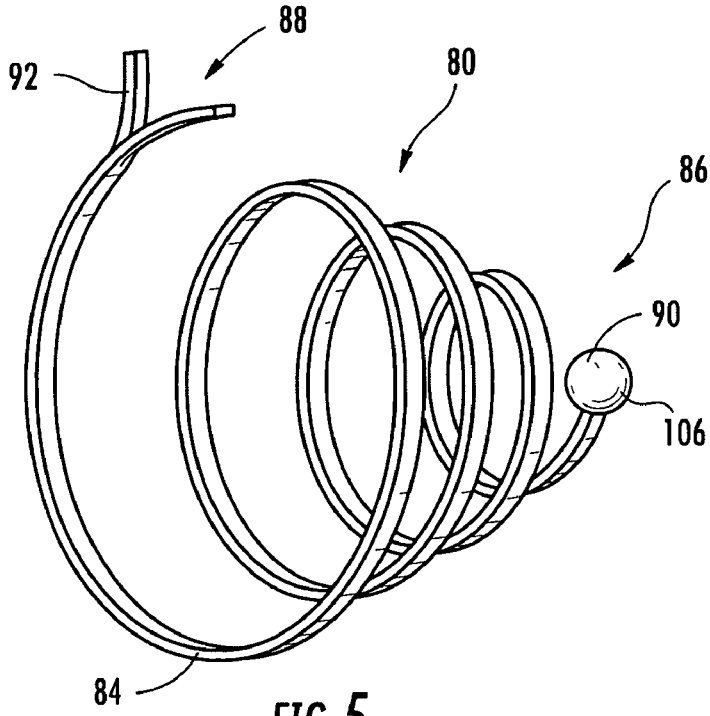
FIG. 5 is a perspective view of an illustrative electrically conductive member of the electrical power disruption device of FIG. 4, with the electrically conductive member wound in a stored mode.

A plurality of electrically conductive members, illustratively strands or streamers 80, are received in a distal portion 82 of the chamber 72. Illustratively, the electrically conductive members 80 each include an elongated flexible body 84 having opposing first and second ends 86 and 88. Illustratively, the first end 86 has a mass greater than the second end 88. More particularly, a weight 90 is illustratively coupled to the first end 86, while a drag member 92 is coupled to the second end 88. When in a stored mode as shown in FIGS. 4 and 5, the flexible body 84 is wound, illustratively coiled in a spiral or helical pattern, to conserve space between opposing first and second ends 86 and 88. In alternative embodiments, the flexible body 84 may be folded back and forth upon itself in the stored mode.

Figure 6:
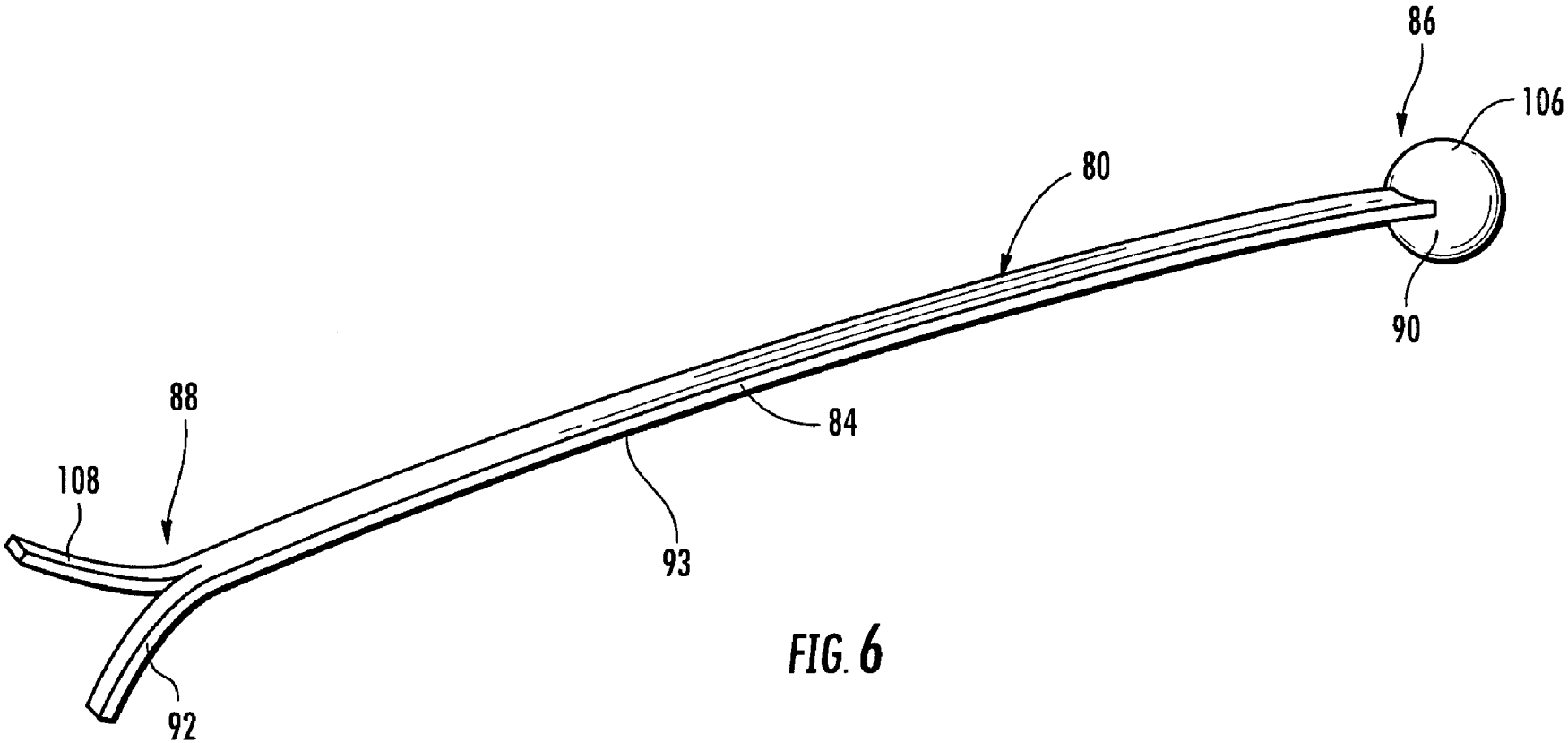
FIG. 6 is a perspective view of the electrically conductive member of FIG. 5, shown in a streaming mode where the first and second ends are extended apart from each other.

Once deployed in a streaming mode as shown in FIGS. 2 and 6, the first and second ends 86 and 88 are spaced apart from each other such that the flexible body 84 defines an extended, substantially linear path. In other words, in the stored mode the distance between the first and second ends 86 and 88 of each electrically conductive member 80 is substantially less than in the streaming mode. In the deployed or steaming mode, each member 80 illustratively has an extended length between opposing ends 86 and 88 of between 3 feet and 10 feet, and may be equal to approximately 5 feet to provide an effective conductive bridge as further detailed herein.

The flexible body 84 of each electrically conductive member 80 is illustratively configured to have aerodynamic characteristics to facilitate the streaming effect upon deployment. More particularly, the dimensions (length, width and thickness) and material properties of the body 84 illustratively provide for aerodynamic drag as the first end 86 essentially pulls the second end 88 in motion. Illustratively, the surface area defined by the lower surface 93 of each flexible body 84 results in an aerodynamic force opposing gravity (i.e., facilitates a floating effect). In one illustrative embodiment, the width of the flexible body 84 is equal to between 0.05 and 0.10 inches, and may be selected to maximize the number of conductive members 80 within the outer diameter of the projectile housing 64 (illustratively, from between about 10 mm to 40 mm). The thickness of the flexible body 84 is dependent upon material selection, required electrical conductivity, and flexibility. In certain instances it is envisioned that the flexible body 84 may have a thickness between 0.005 to 0.010 inches. As further detailed herein, each conductive member 80 is configured to facilitate maximum extension between opposing ends 86 and 88 during deployment. Moreover, the heavier first end 86 and resulting momentum, in combination with the aerodynamic drag of the body 84 and drag member 92 causes the opposing ends 86 and 88 to pull away from each other, thereby extending body 84.

Figure 3:
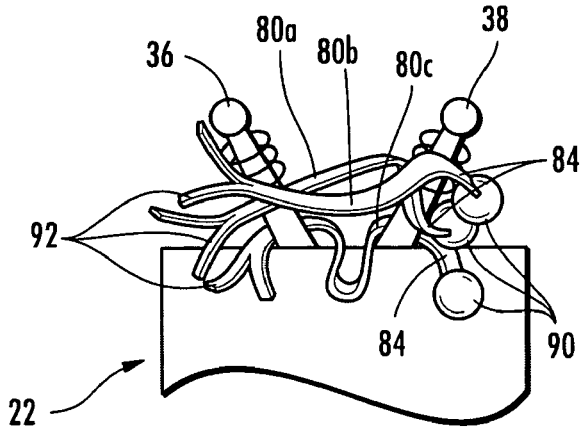
FIG. 3 is a detail view showing the electrically conductive members of the electrical power disruption device of FIG. 2 bridging electrical contacts.

Each flexible body 84 is illustratively formed of an electrically conductive material, such as an electrically conductive microfilament formed of a metal, such as copper, aluminum, or conductive silicon. In one illustrative embodiment, each flexible body 84 is formed of aluminized Mylar®. Alternatively, each flexible body 84 may be formed of an electrical conductive cable or wire. As shown in FIG. 3, the extended length of each electrically conductive member 80 is defined to provide a conductive bridge between potentials or electrical contacts 36 and 38 of conventional power distribution equipment, such as sub-station 22. A plurality of members 80 are configured to be deployed in the streaming mode to increase the probability of short-circuiting the targeted electrical equipment. For example, as shown in FIG. 3, a plurality of members 80*a*, 80*b*, 80*c* increase the probability of establishing an electrical bridge between contacts 36 and 38.

With further reference to FIG. 4, an ejector 94 is received within the proximal portion 96 of the chamber 72 and is configured to force the plurality of electrically conductive members 80 and the end cap 74 outwardly in the deployed or streaming mode as shown in FIG. 2. Illustratively, the ejector 94 includes an explosive 98 configured to be detonated by a primer 100. More particularly, the primer 100 illustratively provides a time delay to permit the projectile to reach a desired elevation before the explosive 98 ejects the members 80. A protective layer 102, illustratively a wadding material, is positioned intermediate the ejector 94 and the electrically conductive members 80 for protecting the strands 80 from the explosive 98.

In the illustrative embodiment shown in FIG. 4, the electrically conductive members 80 in the stored mode are arranged in multiple layers 104*a*, 104*b*, 104*c*, 104*d*, 104*e* to facilitate dispersal of the members 80 upon deployment in the streaming mode. More particularly, upon deployment, the members 80 are ejected outwardly generally along longitudinal axis 73 in a plurality of waves corresponding to successive layers 104*a*, 104*b*, 104*c*, 104*d*, 104*e* to improve efficient placement relative to electrical equipment. In order to facilitate deployment and prevent tangling, the first end 86 including weight 90 is illustratively positioned forward (i.e., in the direction of travel) of the body 84 in the stored mode. Protective members 105, such as felt layers may be positioned intermediate the layers 104 of members 80.

The weight 90 on the first end 86 of each flexible body 84 may be formed of a spherical member 106 formed of a relatively heavy metal, such as lead. The weight 90 is configured to provide a leading edge in the direction of travel of the member 80 in the streaming mode. The drag member 92 is configured to provide aerodynamic resistance to movement of the second end 88 of the member 80 as it moves in its streaming mode. As such, the first end 86 is pulled away from the second end 88 of each member 80, thereby extending the body 84 and facilitating the streaming effect.

Figure 7A:
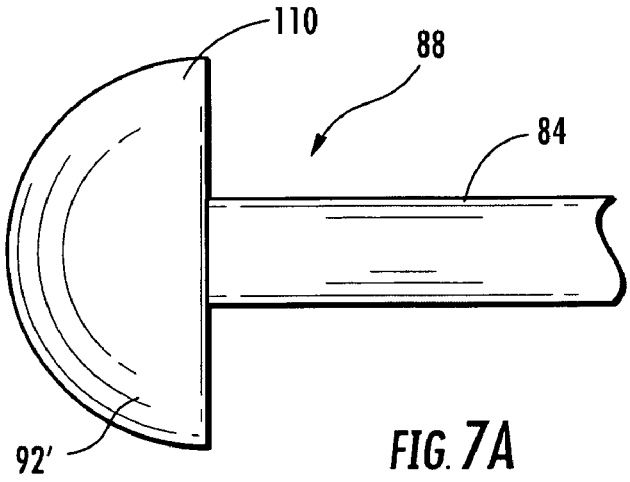
FIG. 7A is a detail view of a further illustrative drag member of the electrically conductive member of FIG. 6.
Figure 7B:
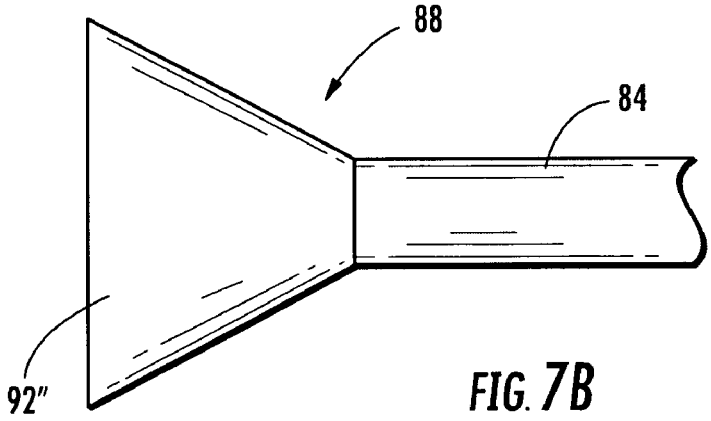
FIG. 7B is a detail view of a further illustrative drag member of the electrically conductive member of FIG. 6.
Figure 7C:
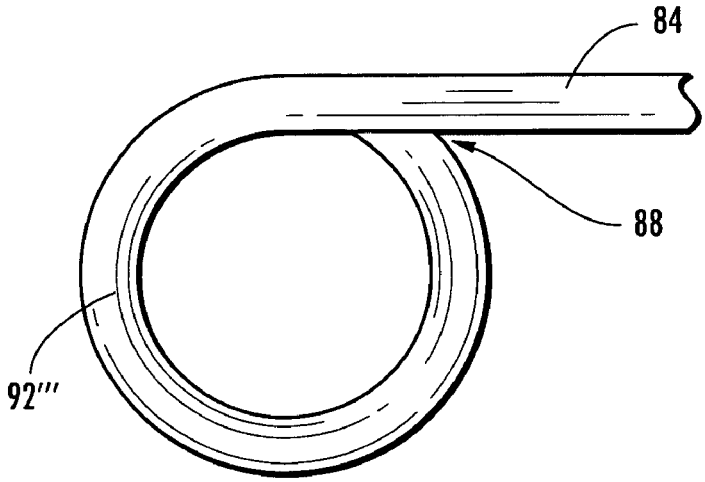
FIG. 7C is a detail view of yet another illustrative drag member of the electrically conductive member of FIG. 6.

As shown in FIG. 6, the drag member 92 may be V-shaped member 108, illustratively formed by separated layers of the body 84. In a further illustrative embodiment as shown in FIG. 7A, the drag member 92' may comprise a rigid cup or flexible parachute 110 coupled to the second end 88 of each member 80. In a further illustrative embodiment as shown in FIG. 7B, the drag member 92" may be in the form of a conical member 112. In FIG. 7C, the drag member 92'" may be part of the flexible body 84 folded back upon itself. It should be appreciated that additional drag members 92 may be substituted for those detailed herein.

In an illustrative method of operation, a user 56 launches the projectile 51 from hand held projectile launcher 52. More particularly, the user 56 illustratively loads the combined projectile 51 and casing 60 within the launching tube 54. By depressing the trigger 58, the firing pin 59 impacts the casing 60, causing detonation of the primer 61 and propellant 62. The projectile 51 is propelled from the discharge end 63 of the launch tube 54 upwardly along trajectory 65. At a given distance, as determined by the time taken for the primer 100 to detonate the explosive 98, the electrically conductive members 80 are forced outwardly though the distal end 76 of the housing 64. Given the weights 90 and drag members 92 on the respective electrically conductive members 80, each flexible body 84 extends as a streamer above the desired power distribution equipment, for example sub-station 22. As the members 80 fall onto the power distribution equipment, various members 80 conductively bridge potential or electrical contacts (such as contacts 36 and 38), thereby short circuiting the equipment. Safety features, such as protective devices (e.g., circuit breakers) in the power distribution equipment illustratively activate or trip, thereby temporarily disabling the power transmission. The resulting damage is not catastrophic and may be repaired with relative ease and efficiency, particularly compared to the destruction caused by conventional weapons.

As may be appreciated, the disruption device 50 of the present disclosure may be utilized by a variety of users, such as soldiers, law enforcement personnel, and power operators to provide quick, effective, and temporary disruption of power distribution. For example, law enforcement personnel (e.g., SWAT officers) could deploy the projectile 51 above a transformer 30 (FIG. 1) using handheld launcher 52 to quickly interrupt power to a limited number of consumers 14 (e.g., in situations where suspects are barricaded within a building).

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

The invention claimed is:

1. A method of disrupting electrical power transmission, the method comprising the steps of:

launching a projectile above power transmission equipment, the projectile including a chamber receiving a plurality of electrically conductive streamers, each streamer having a first end with a mass greater than an opposing second end;

ejecting the plurality of electrically conductive streamers from the projectile in a direction of travel;

causing each of the plurality of electrically conductive streamers to extend in a streaming manner such that the first end leads the second end in the direction of travel; and bridging electrical contacts of the power transmission equipment by the plurality of electrically conductive streamers descending onto the power transmission equipment.

2. The method of claim 1, wherein the step of launching includes the steps of providing a hand-held launcher including a launch tube, and propelling the projectile from the launch tube.

3. The method of claim 2, wherein the step of propelling the projectile includes activating a propellant located within the launch tube behind the projectile.

4. The method of claim 1, wherein each of the electrically conductive streamers includes a weight supported at the first end and a drag member supported at the second end, the weight configured to lead the electrically conductive streamers in the direction of travel and the drag member configured to provide aerodynamic resistance to movement of the second end of the streamers and cause extension of the first end relative to the second end.

5. The method of claim 1, wherein the step of ejecting includes the steps of providing an explosive charge and a primer within the chamber of the projectile, and detonating the explosive charge with the primer.

6. The method of claim 1, wherein each of the electrically conductive streamers has an extended length of at least three feet.

7. The method of claim 1, wherein the streamers when extending in a streaming manner cause an aerodynamic drag between the first and second ends.

8. The method of claim 1, wherein each of the electrically conductive streamers includes a flexible body formed of aluminized polyester film.

9. The method of claim 1, wherein each of the electrically conductive streamers is wound to conserve space when in a stored mode within the chamber of the projectile prior to the step of ejecting.

10. A method of disrupting electrical power transmission, the method comprising the steps of:

providing a hand-held launcher including a launch tube;

placing a projectile and a propellant within the launch tube;

activating the propellant for launching the projectile to higher elevation above power transmission equipment;

ejecting a plurality of electrically conductive members from the projectile; and bridging electrical contacts of the power transmission equipment by the plurality of electrically conductive members descending onto the power transmission equipment.

11. The method of claim 10, wherein each electrically conductive member includes a first end with a mass greater than an opposing second end such that the first end leads the second end in a direction of travel.

12. The method of claim 11, wherein each electrically conductive member includes a weight supported at the first end and a drag member supported at the second end, the weight configured to lead the electrically conductive member in the direction of travel and the drag member configured to provide aerodynamic resistance of the second end of the electrically conductive member and cause extension of the first end relative to the second end.

13. The method of claim 10, wherein the step of ejecting includes the steps of providing an explosive charge and a primer within the projectile, and detonating the explosive charge with the primer.

14. The method of claim 10, wherein each of the electrically conductive members includes a flexible body formed of aluminized polyester film.

15. The method of claim 10, wherein each of the electrically conductive members is wound to conserve space when in a stored mode within the projectile prior to the step of ejecting.

* * * * *